US007317882B2

(12) United States Patent
Dombrowski

(10) Patent No.: US 7,317,882 B2
(45) Date of Patent: Jan. 8, 2008

(54) APPARATUS AND METHOD TO OPTIMIZE PRINTER MEDIA DEFINITION

(75) Inventor: James J. Dombrowski, Webster, NY (US)

(73) Assignee: Xerox Corporation, Stamford, CT (US)

( * ) Notice: Subject to any disclaimer, the term of this patent is extended or adjusted under 35 U.S.C. 154(b) by 57 days.

(21) Appl. No.: 11/199,333

(22) Filed: Aug. 8, 2005

(65) Prior Publication Data

US 2007/0031162 A1 Feb. 8, 2007

(51) Int. Cl.
*G03G 15/00* (2006.01)

(52) U.S. Cl. ..... 399/81; 399/391

(58) Field of Classification Search ..... 399/81, 399/388, 389, 391, 393
See application file for complete search history.

(56) References Cited

U.S. PATENT DOCUMENTS 4,603,962 A 8/1986 Dekura ..... 355/3 R
5,081,595 A 1/1992 Moreno et al. ..... 395/111
5,167,013 A 11/1992 Hube et al. ..... 395/110
5,229,814 A 7/1993 Hube et al. ..... 355/203
5,237,379 A * 8/1993 Sklut et al.
6,647,222 B1 11/2003 Digby et al. ..... 399/81

* cited by examiner

*Primary Examiner*—David M. Gray
*Assistant Examiner*—Laura K Roth
(74) *Attorney, Agent, or Firm*—Alix, Yale & Ristas, LLP

(57) ABSTRACT

A printer includes a first paper tray carrying a selected print medium and a user interface having a control associated with a selected attribute of the set of attributes defining all print media. The control has a first input device providing a control system input selectively associating a range of values of the selected attribute with the first paper tray. The printer control system feeds the print mechanism from the first paper tray when a print job is received, designating media having a value for the selected attribute falling within the range of values associated with the first paper tray.

17 Claims, 4 Drawing Sheets

APPARATUS AND METHOD TO OPTIMIZE PRINTER MEDIA DEFINITION

BACKGROUND

This disclosure relates generally to electronic printing systems, and more particularly to a process and apparatus for substituting an available stock type for use in place of the stock type programmed for a print job when the programmed stock type is unavailable.

In the office-equipment context, such as including copiers and printers, it is generally well known to provide, with each machine, a plurality of selectable trays, each having an identifiable type of print media therein. Different types of media may typically include papers of different sizes or colors, or transparency media. With specific users, however, there may be very specific types of media, such as different types of letterhead or other user-specific forms.

In situations where a plurality of copiers and printers are in communication with various computers through a network, a user originating a print job at a computer will wish to locate a machine having a correct type of media on which to print. Where the selection of available types of media is wide, such as including specific types of letterhead, a user at a computer will wish to have this very specific information about the media in each tray of many machines displayed to him in detail.

In the prior art, however, there are practical constraints on giving a user such a "complete picture". Very often the data structures and communication among computers and machines is incapable of describing the media in a particular tray beyond a basic, "choose one of the following" description such as "A4." Also, the fact that machines may be widely distributed geographically, with various machines being under the control of local key operators (who are responsible for maintaining supplies in each tray), creates a danger that a description of the media which is displayed to the user may become incorrect.

The Xerox DocuTech Production Publisher ("Xerox" and "DocuTech" are registered Trademarks of Xerox Corporation, Stamford, Conn.) employs a different system. There, as described more fully in U.S. Pat. No. 5,081,595 to Josefina Moreno et al., and entitled "Paper Supply Tray Status In Electronic Printers" issued on Jan. 14, 1992, the pertinent portions of which are incorporated herein, the user specifies both the stock characteristics (i.e., size, color, type) required for the print job and the characteristics of the paper stock loaded in the paper trays. The system then determines which paper tray, if any, contains the paper stock that matches the job's requirements. If a match is found, the paper stock is used and the job proceeds. If a match is not found, the job is faulted and the operator is instructed to load the proper stock.

While this latter type of printing system has greatly and advantageously expanded the number of paper stock characteristics that may be specified for a print job, it has also brought attention to the situation where the printing system sites are unable to stock all of the many types of paper stock that may be programmed by customers. This inability to stock all the various types of paper stock may be due to lack of room at the site, cost, etc.

Although a print job may, in the event that the paper stock programmed for the job is not available at the site, be turned away, this is not desirable nor normally a good business practice. On the other hand, the site operator might try to re-program the job with a different stock but this could be a time consuming and uneconomical process, particularly where the number of print jobs programmed for unavailable paper stock types is large.

U.S. Pat. No. 6,647,222 to Anthony Digby et al., and entitled "Print Media Supply Identification for a Copier or Printer" issued on Nov. 11, 2003 discloses a digital printer that retains in memory detailed alphanumeric data describing the contents of its paper trays, as well as describing any unusual features thereof. The alphanumeric data is entered at the local user interface of the printer, and is retained at the printer so it can be accessed by a remote user computer as needed. The alphanumeric data can be subject to search techniques by which a large number of printers can be searched for certain print media or other properties.

While this type of printing system has also greatly and advantageously facilitated the user's ability to determine the paper stock characteristics that may be available at the printers to which he or she has access, it is also subject to the limitation that the printing system sites are unable to stock all of the many types of paper stock that may be programmed by customers. If the user cannot access a printer having the paper stock programmed for the job, the print job is turned away.

SUMMARY

There is provided a printer for printing on multiple print media defined by a set of attributes. Each attribute within the set of attributes has a set of values that includes all such values that may be used to identify the associated attribute across all of the print media. The printer comprises a print mechanism, a first paper tray carrying a selected print medium, a control system and a user interface. The user interface includes a control associated with a selected attribute of the set of attributes. The control has a first input device providing a control system input selectively associating a range of values within the set of values of the selected attribute with the first paper tray. The control system feeds the print mechanism from the first paper tray when a print job is received, designating media having a value for the selected attribute falling within the range of values associated with the first paper tray.

The control associated with the selected attribute may also include a second input device providing a control system input selectively associating all values within the set of values of the selected attribute with the first paper tray. The control system feeds the print mechanism from the first paper tray when a print job is received, designating media having a value for the selected attribute equal to the set of values associated with the first paper tray.

The control associated with the selected attribute may also include a third input device providing a control system input selectively associating a specific value within the set of values of the selected attribute with the first paper tray. The control system feeds the print mechanism from the first paper tray when a print job is received, designating media having a value for the selected attribute equal to the value associated with the first paper tray.

The user interface may also include a control, associated with a second selected attribute of the set of attributes, including a first input device providing a control system input selectively associating a range of values within the set of values of the second selected attribute with the first paper tray. The control system feeds the print mechanism from the first paper tray when a print job is received, designating media having a value for the selected attribute and a value for the second selected attribute falling within the range of values associated with the first paper tray. The printer control associated with the second selected attribute may further include a second input device providing a control system input selectively associating all values within the set of values of the second selected attribute with the first paper tray. The control system feeds the print mechanism from the first paper tray when a print job is received, designating media having a value for the selected attribute falling within the range of values associated with the first paper tray and a value for the second selected attribute equal to the set of values associated with the first paper tray.

The user interface may also include a control associated with a second selected attribute of the set of attributes, the control including a first input device providing a control system input selectively associating a range of values within the set of values of the second selected attribute with the first paper tray. The control system feeds the print mechanism from the first paper tray when a print job is received, designating media having a value for the selected attribute falling within the range of values associated with the first paper tray and a value for the second selected attribute equal to the set of values associated with the first paper tray. The control associated with the second selected attribute may further include a second input device providing a control system input selectively associating all values within the set of values of the second selected attribute with the first paper tray. The control system feeds the print mechanism from the first paper tray when a print job is received, designating media having a value for the selected attribute equal to the set of values associated with the first paper tray and a value for the second selected attribute equal to the set of values associated with the first paper tray.

The printer may further comprise a subsequent paper tray carrying another selected print medium. The user interface selectively associates a range of values within the set of values of the selected attribute, all values within the set of values of the selected attribute, or a specific value within the set of values of the selected attribute with the subsequent paper tray.

There is also provided a method of optimizing print media definition comprising loading a first print media selected from a plurality of print media into a first paper tray of a printer. A range of values of at least one of the attributes of the first paper is selectively associated with the first paper tray, using a printer user interface, where all print media is defined by a set of attributes. Each attribute within the set of attributes has a set of values that includes all such values that may be used to identify the associated attribute across all of the print media. A print mechanism of the printer is fed from the first paper tray if the ranges of values associated with the first paper tray includes the print media attributes required by a print job received by a control system of the printer.

A subsequent print media may be loaded into at least one subsequent paper tray of a printer, where at least one of the attributes for the subsequent print media has a value that is different from the value for a corresponding attribute of the first print media or a corresponding attribute of another subsequent print media. A range of values of at least one of the attributes of the subsequent paper is selectively associated with the subsequent paper tray, using the printer user interface. It is determined whether the ranges of values associated with the first paper tray or the subsequent paper tray include the print media attributes required by a print job received by a control system of the printer, and a print mechanism of the printer is fed from the one of the first paper tray or subsequent paper tray having the ranges of values including the print media attributes required by the print job.

A specific value of at least one other of the attributes of the first paper may be selectively associated with the first paper tray, using the printer user interface. The print mechanism of the printer is from the first paper tray if the ranges of values and the specific values associated with the first paper tray include the print media attributes required by a print job received by a control system of the printer.

All values of at least one other of the attributes of the first paper may be selectively associated with the first paper tray, using a printer user interface. The print mechanism of the printer is fed from the first paper tray if the values associated with the first paper tray include the print media attributes required by a print job received by a control system of the printer.

BRIEF DESCRIPTION OF THE DRAWINGS

The present embodiment may be better understood and its numerous objects and advantages will become apparent to those skilled in the art by reference to the accompanying drawings in which.

DETAILED DESCRIPTION

Figure 1:
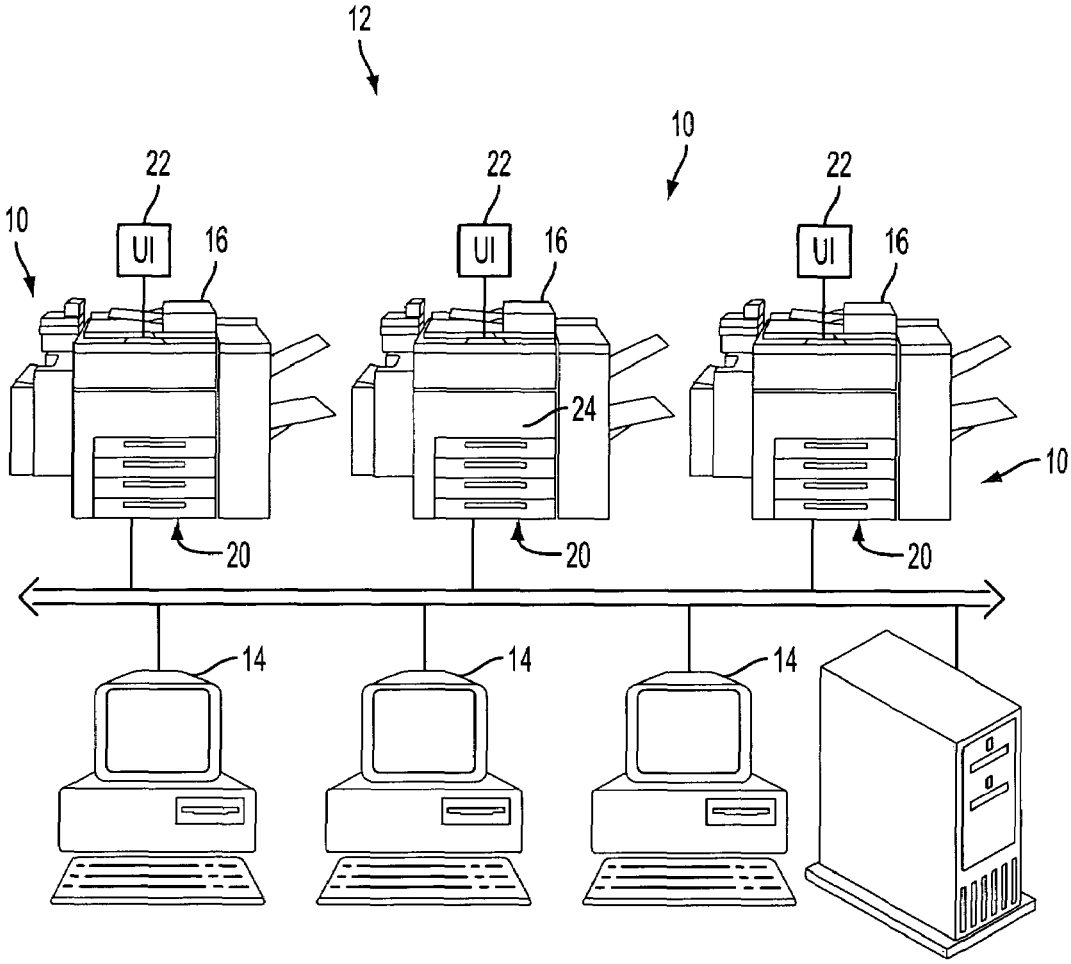
FIG. 1 is a diagram showing a network of user computers which can selectively operate one or a plurality of printers and copiers.

FIG. 1 shows a network 12 of user computers 14 which can selectably operate one of a plurality of printers 16 and copiers. As is familiar in the art, many digital copiers and facsimile machines function as printers 16, in that they output images based on data originating at a computer 14, and so for present purposes the term "printer" as used herein encompasses any apparatus such as a digital copier, bookmaking machine, facsimile machine, multi-function machine, etc. which performs a print outputting function for any purpose. Each user computer 14 is capable of sending print job data to a selected printer 16 over a network 12. Each printer 16 includes a plurality of what are here called paper trays 20 (but which can be in any physical form and can conceivably retain any kind of print medium), within each printer 16. Each printer 16 can include thereon a local user interface (UI) 22 through which instructions can be entered into a control system 24 associated with the machine. The UI may be any conventional user interface, such as a keyboard or mouse. In one embodiment, the UI 22 comprises an LCD "touchscreen" 26, as will be described below, but more broadly such a touchscreen 26 can be defined as any variable display.

All print media (i.e. paper) may be defined by the a common set of attributes, with each specific medium being defined by specific values for each attribute in the set of attributes. That is, every type of print medium has a type, a size, a color, a weight, etc, while each specific print medium has specific values for the type, size, color, weight, etc. For example, the print medium (A4 paper) on which this application is printed has the following attribute values: type-plain; size-21.0 cm×29.7 cm; color-white; weight-90 gsm. Accordingly, the term "attribute" as used herein encompasses any type of characteristic, such as type, size, color, weight, etc, by which print media may be identified. In addition, the term "set of attributes" as used herein encompasses a set of one or more "attributes", as defined above, that may be used to identify all types of media. Further, the term "value" as used herein encompasses any specific characteristic by which specific values for the attributes of a specific print medium may be identified. For example, the set of values "plain", "lightweight", "recycled", "mylar", etc. are associated with the attribute "type". Similarly, "letter", "legal", "executive", "A4", "A5", "A6", etc. are associated with the attribute "size"; "blue", "green", etc. are associated with the attribute "color"; and "lb", "gsm", etc. are associated with the attribute "weight". It should be appreciated that each "set" of values includes all such values that may be used to identify the associated attribute across the complete range of print media. Accordingly, the term "range of values" as used herein encompasses any subset of one of the set of values, including the subset containing all of the values in the set of values.

Jobs may be received with various combinations of attributes. These attributes are very useful in enabling the printer to deliver exactly the output desired. However, they can sometimes get in the way, preventing the creation of any output at all because of a mismatch that may not seem significant at the time. Because of this, most networked printing devices allow for bypassing some of these attributes, or for a defined substitution if the desired attribute is not currently available. While this conventional method works, it is difficult to implement and difficult for the customer to understand and use.

Figure 2:
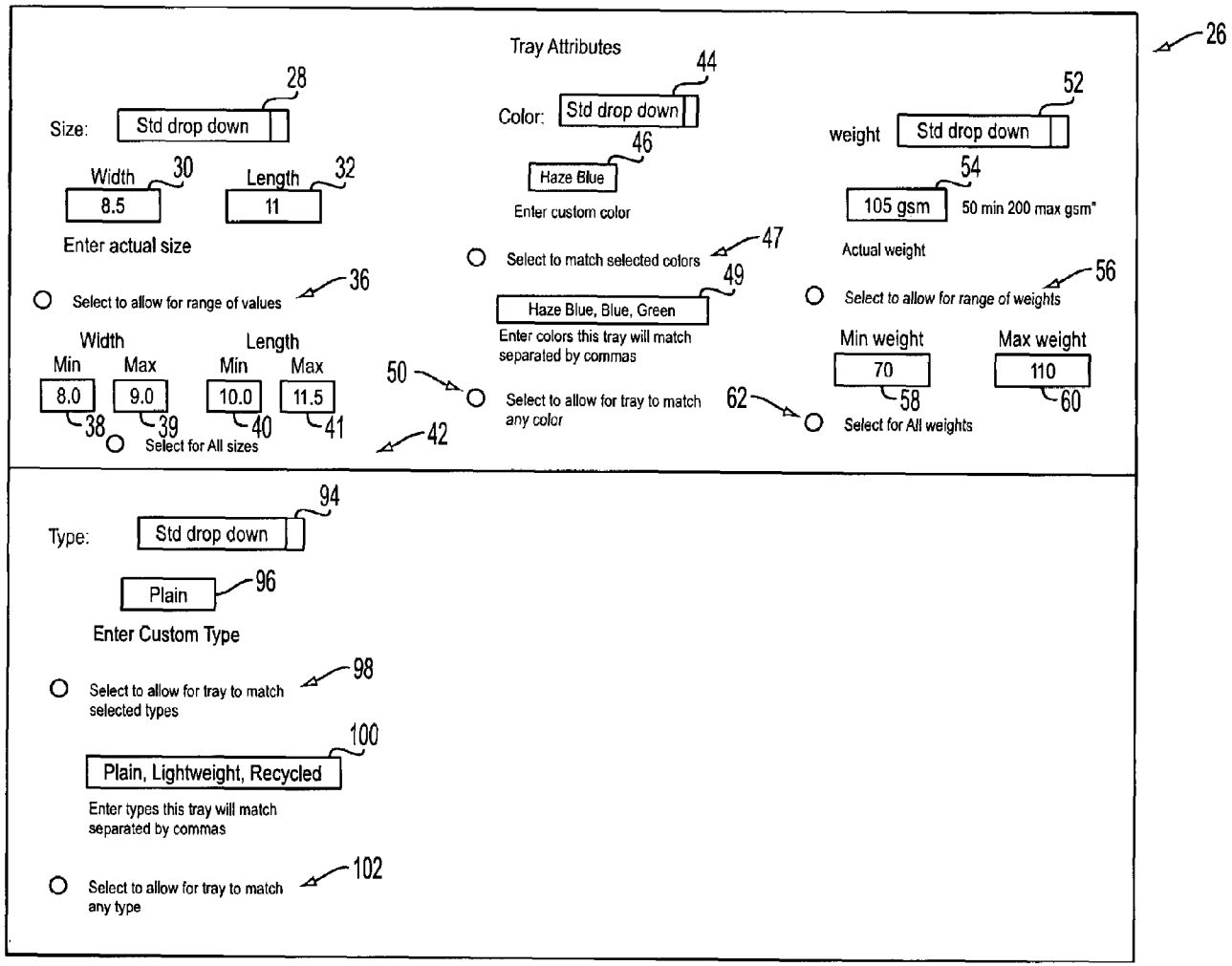
FIG. 2 is a view of the feeder programming touchscreen.

FIG. 2 shows a view of a touchscreen 26 that would appear to an operator who is loading print medium into a particular printer 16. The display, which is of course one of many possible displays retained in a memory associated with the UI 22, includes controls for programming the physical attributes for the printer medium loaded in each paper tray 20 of the printer 16. More specifically, the UI 22 includes controls for programming a range of values for the physical attributes for the printer media, allowing the printer medium loaded in any particular tray of the printer 16 to be utilized for a variety of print jobs, where the print jobs have different types of media programmed therein. The UI 22 also includes controls for programming the specific physical attributes of the printer medium loaded in a paper tray 20, allowing the printer 16 to utilize that paper tray 20 in a conventional manner. The attributes entered via the UI 22 are stored in memory in the control system 24 and displayed on the UI 22. The operator may easily reprogram the attribute information for any tray 20, when the printer medium stored in the paper tray 20 is changed.

In the example of FIG. 2, the printer media attributes that may be programmed by the operator for each paper tray 20 include the media type, size, color and weight of the printer media. Other printer media attributes may also be programmed. For example, the type of printer media (e.g. plain, recycled, etc.) may be programmed.

Figure 3:
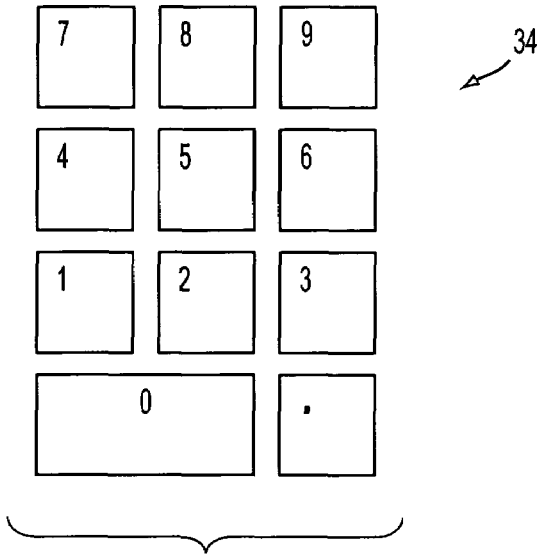
FIG. 3 is a view of the numeric keypad touchscreen.

With regard to the printer media size, the operator may specify the specific size of the printer media. If the printer media has a standard size, the operator may actuate a drop down menu 28, containing a listing of such standard sized printer media, and select the size for the printer medium loaded in the paper tray 20. If the printer medium does not have a standard size, the printer medium size is not included in the drop down menu 28, or merely as an alternative to utilizing the drop down menu 28, the operator may enter the width and length of the printer medium in the associated windows 30, 32 of the touchscreen 26. The touchscreen windows 30, 32 may include scroll cursors allowing the operator to scroll up or down to the appropriate value for the width or length. Alternatively, touching the touchscreen window 30, 32 may actuate a numeric keypad 34 displayed on the touchscreen 26 (FIG. 3) for entering the appropriate value for the width or length. If the operator wishes to enter a specific range of values for the width and/or the length of the printer medium, he or she may select the option 36 to allow a range of values and enter the width range of values and/or length range of values for the printer medium in the associated windows 38, 39, 40, 41 of the touchscreen 26. The touchscreen windows 38, 39, 40, 41 may include scroll cursors allowing the operator to scroll up or down to the appropriate value, or selecting the option may actuate a numeric keypad 34 displayed on the touchscreen 26. The touchscreen 26 may also include a "wildcard" option 42, allowing any printer media in the paper tray 20 to be used for any print job sent to the printer 16, no matter what size is specified in the print job. Since the use of a wildcard option 42 may result in some pretty strange looking jobs (e.g. image severely cut off or small image on large paper), the availability of this option 42 may be administratively controlled. As a quality control check, the control system 24 verifies that the paper size sensed by the paper size tray sensors for the printer medium loaded in the paper tray is either the designated size or falls within the designated size range.

Figure 4:
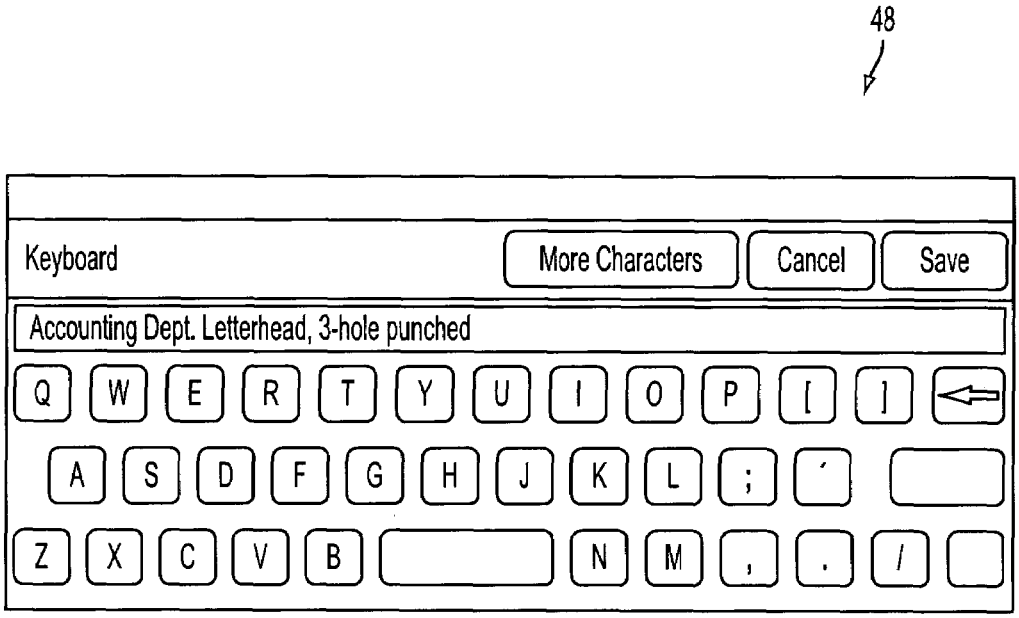
FIG. 4 is a view of the alphabetic keypad touchscreen.

With regard to the printer media color, the operator may specify the specific color of the printer medium. If the printer medium has a standard color, the operator may actuate a drop down menu 44, containing a listing of such standard colored printer media, and select the color for the printer medium loaded in the paper tray 20. If the printer medium does not have a standard color, the printer medium color is not included in the drop down menu 44, or merely as an alternative to utilizing the drop down menu, the operator may enter the color of the printer medium in the associated window 46 of the touchscreen 26. Touching the touchscreen window 46 actuates an alphabetic keypad 48 displayed on the touchscreen 26 (FIG. 4) for entering the appropriate color. If the operator wishes to enter a specific range of values for the color of the printer medium, he or she may select the option 47 to allow a range of values and enter the range of colors for the printer medium in the associated window 49 of the touchscreen. The touchscreen window 49 may include scroll cursors allowing the operator to scroll up or down to the appropriate value, or selecting the option 47 may actuate a numeric keypad 34 displayed on the touchscreen 26. The operator may elect to use a wildcard option 50, allowing any printer media in the paper tray 20 to be used for any print job sent to the printer, no matter what color is specified in the print job.

With regard to the printer media weight, the operator may specify the specific weight of the printer medium. If the printer medium has a standard weight, the operator may actuate a drop down menu 52, containing a listing of such standard weight printer media, and select the weight for the printer medium loaded in the paper tray 20. If the printer medium does not have a standard weight, the printer medium weight is not included in the drop down menu 52, or merely as an alternative to utilizing the drop down menu 52, the operator may enter the weight of the printer medium in the associated window 54 of the touchscreen 26. The touchscreen window 54 may include scroll cursors allowing the operator to scroll up or down to the appropriate value, or selecting the option may actuate a numeric keypad 34 displayed on the touchscreen 26. If the operator wishes to enter a specific range of values for the weight of the printer medium, he or she may select the option 56 to allow a range of values and enter the range of values for the printer medium in the associated windows 58, 60 of the touchscreen. The touchscreen windows 58, 60 may include scroll cursors allowing the operator to scroll up or down to the appropriate value, or selecting the option 56 may actuate a numeric keypad 34 displayed on the touchscreen 26. The touchscreen 26 may also include a wildcard option 62, allowing any printer media in the paper tray 20 to be used for any print job sent to the printer 16, no matter what weight is specified in the print job.

With regard to the printer media type, the operator may specify the specific type of the printer medium. If the printer medium has a standard type, the operator may actuate a drop down menu 94, containing a listing of such standard type printer media, and select the type for the printer medium loaded in the paper tray 20. If the printer medium does not have a standard type, the printer medium type is not included in the drop down menu 94, or merely as an alternative to utilizing the drop down menu 94, the operator may enter the type of the printer medium in the associated window 96 of the touchscreen 26. The touchscreen window 96 may include scroll cursors allowing the operator to scroll up or down to the appropriate value, or selecting the option may actuate a numeric keypad 34 displayed on the touchscreen 26. If the operator wishes to enter a specific range of values for the type of the printer medium, he or she may select the option 98 to allow a range of values and enter the range of values for the printer medium in the associated window 100 of the touchscreen. The touchscreen window 100 may include scroll cursors allowing the operator to scroll up or down to the appropriate value, or selecting the option 98 may actuate a numeric keypad 34 displayed on the touchscreen 26. The touchscreen 26 may also include a wildcard option 102, allowing any printer media in the paper tray 20 to be used for any print job sent to the printer 16, no matter what type is specified in the print job.

Figure 5:
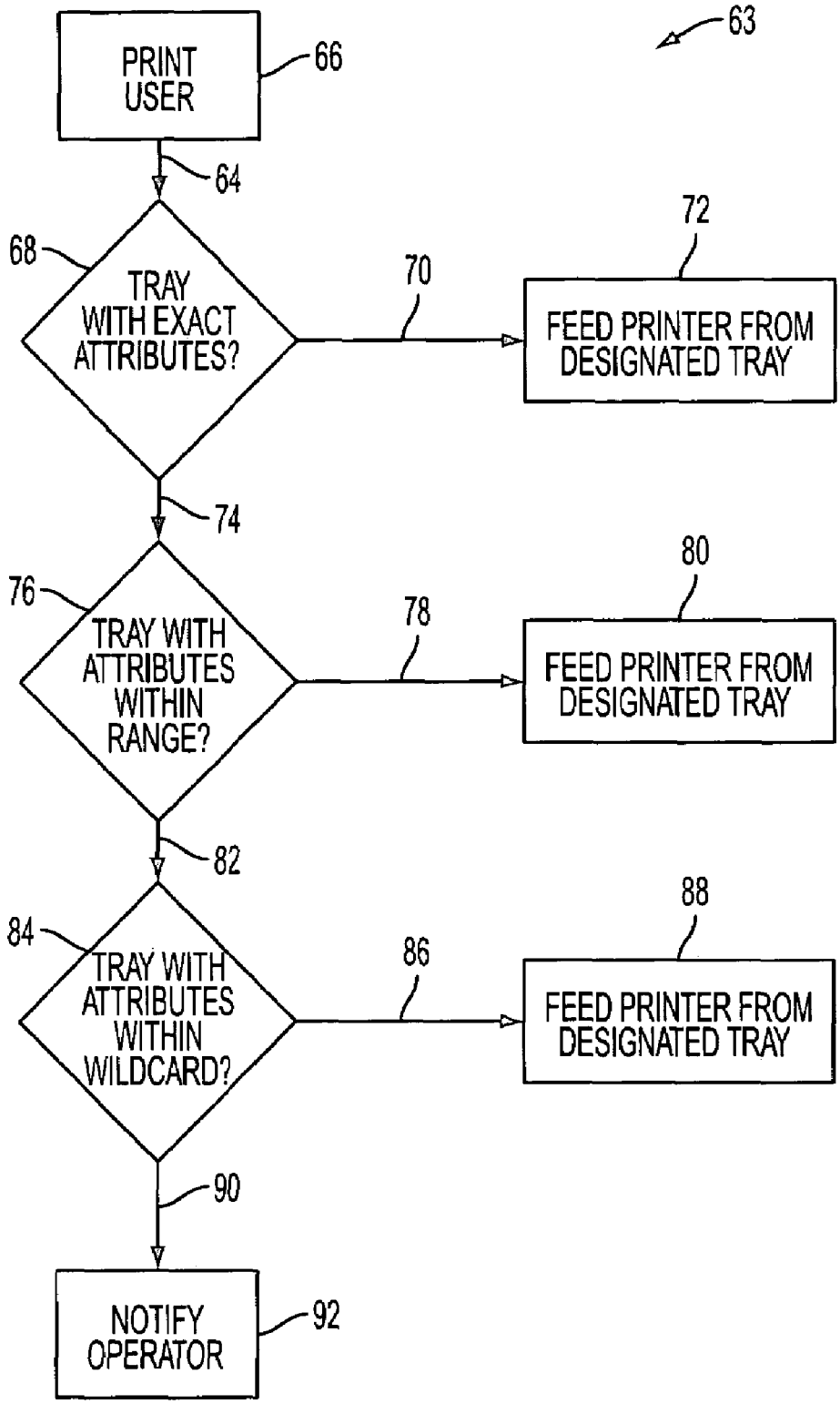
FIG. 5 is a flow diagram of a method of optimizing printer media definition.

With reference to FIG. 5, a method 63 of optimizing printer media definition is disclosed wherein when a print job is received 64 from a print user 66, the printer control system 24 first determines 68 whether any of the paper trays 20 contains printer media having the exact attributes required by the print job. If one of the paper trays contains such printer media 70, the printer control system feeds 72 the print mechanism of the printer 16 from the designated paper tray 20. If none 74 of the paper trays 20 contains printer media having the exact attributes required by the print job, the printer control system 24 then determines 76 whether any of the paper trays 20 contains printer media having specified ranges of values for the printer media attributes that include the attributes required by the print job. If one of the paper trays contains such printer media 78, the printer control system feeds 80 the printer 16 from the designated paper tray 20. If none 82 of the paper trays 20 contains printer media having specified ranges of values for the printer media attributes that include the attributes required by the print job, the printer control system 24 then determines 84 whether any of the paper trays 20 contains printer media having wild card ranges for the printer media attributes that include the attributes required by the print job. If one of the paper trays contains such printer media 86, the printer control system feeds 88 the printer 16 from the designated paper tray 20. If none 90 of the paper trays 20 contains printer media having wild card ranges for the printer media attributes that include the attributes required by the print job, the printer control system 24 notifies 92 the operator that the print job cannot be printed on the printer 16. Such notification may include an alarm sound and/or a message displayed on the UI 22.

In the event that more than one tray contains printer media having the exact attributes required by the print job 70, more than one tray contains printer media having specified ranges of values for the printer media attributes that include the attributes required by the print job 78, or more than one tray contains printer media having wild card ranges for the printer media attributes that include the attributes required by the print job 86, the printer control system will determine which of the trays meeting the attribute criteria is highest in a default tray ranking and feed the printer 16 from such tray.

The flexibility provided by the above-described system 10 and method 63 allows the operator to decide what types of output he or she wants each tray to be used for. For example, if the print shop is able to obtain a great price on 100 gsm paper, the operator may use this as a price advantage and print all possible jobs using this paper. When loading that paper, the operator can define the range of weight to either be very broad or even the wildcard, so that no mater what the print driver may have specified, the weight will still be compatible.

The subject system 10 and method 63 also has the advantage of centralizing the programming of media related attributes in one place, tray programming, and allows for substitutions to be handled in that dialog rather than having to open up a different dialog. In contrast, the Xerox DocuTech® family of printers has a system that helps guide the operator through the process to correct such media mismatch problems. This method is good in that it is very exact and job specific, but has the drawback of requiring operator involvement and requires that the job attributes be modified in order to enable printing. The subject system 10 and method 63 may be used in conjunction with DocuTech® type exact match media selection to reduce the need for operator involvement. The subject system 10 and method 63 allows for operator control but is "automatic" and is well suited for "casual operator" and multi user systems where operator intervention is not desired.

The subject system 10 and method 63 also gives a greater level of control to the machine operator. For example, a print shop may adopt the policy of programming one of the lower capacity trays with a range sizes and/or weights to allow some flexibility of substitution while limiting the number of copies that may be printed without operator intervention. By requiring the operator to verify the quality of the printed copies before refilling the paper tray, the print shop limits the number of "bad" prints that may be produced. A system wide substitution does not provide this option, even extremely large jobs could print without requiring the operator to check that prints are satisfactory.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printer for printing on a plurality of print media defined by a set of attributes, each attribute within the set of attributes having a set of values that includes all such values that may be used to identify the associated attribute across all of the print media, the printer comprising:

a print mechanism;

a first paper tray carrying a selected print medium;

a control system; and a user interface including a control associated with a selected attribute of the set of attributes, the control including a first input device selected from a keyboard, a pointing device or a touchscreen providing a control system input selectively associating a range of values within the set of values of the selected attribute with the first paper tray;

wherein the control system feeds the print mechanism of the printer from the first paper tray when the printer receives a print job designating media having a value for the selected attribute falling within the range of values associated with the first paper tray.

2. The printer of claim 1 wherein the control associated with the selected attribute also includes a second input device selected from a keyboard, a pointing device or a touchscreen providing a control system input selectively associating all values within the set of values of the selected attribute with the first paper tray, wherein the control system feeds the print mechanism from the first paper tray when the printer receives a print job designating media having a value for the selected attribute equal to the set of values associated with the first paper tray.

3. The printer of claim 2 wherein the control associated with the selected attribute also includes a third input device selected from a keyboard, a pointing device or a touchscreen providing a control system input selectively associating a specific value within the set of values of the selected attribute with the first paper tray, wherein the control system feeds the print mechanism from the first paper tray when the printer receives a print job designating media having a value for the selected attribute equal to the value associated with the first paper tray.

4. The printer of claim 2 wherein the user interface also includes a control associated with a second selected attribute of the set of attributes, the control including a first input device selected from a keyboard, a pointing device or a touchscreen providing a control system input selectively associating a range of values within the set of values of the second selected attribute with the first paper tray, wherein the control system feeds the print mechanism from the first paper tray when the printer receives a print job designating media having a value for the selected attribute falling within the range of values associated with the first paper tray and a value for the second selected attribute equal to the set of values associated with the first paper tray.

5. The printer of claim 4 wherein the control associated with a second selected attribute also includes a second input device selected from a keyboard, a pointing device or a touchscreen providing a control system input selectively associating all values within the set of values of the second selected attribute with the first paper tray, wherein the control system feeds the print mechanism from the first paper tray when the printer receives a print job designating media having a value for the selected attribute equal to the set of values associated with the first paper tray and a value for the second selected attribute equal to the set of values associated with the first paper tray.

6. The printer of claim 1 wherein the user interface also includes a control associated with a second selected attribute of the set of attributes, the control including a first input device selected from a keyboard, a pointing device or a touchscreen providing a control system input selectively associating a range of values within the set of values of the second selected attribute with the first paper tray, wherein the control system feeds the print mechanism from the first paper tray when the printer receives a print job designating media having a value for the selected attribute and a value for the second selected attribute falling within the range of values associated with the first paper tray.

7. The printer of claim 6 wherein the control associated with a second selected attribute also includes a second input device selected from a keyboard, a pointing device or a touchscreen providing a control system input selectively associating all values within the set of values of the second selected attribute with the first paper tray, wherein the control system feeds the print mechanism from the first paper tray when the printer receives a print job designating media having a value for the selected attribute falling within the range of values associated with the first paper tray and a value for the second selected attribute equal to the set of values associated with the first paper tray.

8. The printer of claim 1 further comprising a subsequent paper tray carrying another selected print medium, the user interface selectively associating a range of values within the set of values of the selected attribute, all values within the set of values of the selected attribute, or a specific value within the set of values of the selected attribute with the subsequent paper tray.

9. A method of optimizing print media definition comprises:

loading a first print media selected from a plurality of print media into a first paper tray of a printer, the plurality of print media being defined by a set of attributes, each attribute within the set of attributes having a set of values that includes all such values that may be used to identify the associated attribute across all of the print media, the first print media having specific values for the set of attributes;

selectively associating a range of values of at least one of the attributes of the first paper with the first paper tray, using a printer user interface selected from a keyboard, a pointing device or a touchscreen; and feeding a print mechanism of the printer from the first paper tray if the ranges of values associated with the first paper tray includes the print media attributes required by a print job received by a control system of the printer.

10. The method of claim 9 further comprising:

loading a subsequent print media selected from the plurality of print media into at least one subsequent paper tray of a printer, the subsequent print media having specific values for the set of attributes, at least one of the attributes for the subsequent print media having a value that is different from the value for a corresponding attribute of the first print media or a corresponding attribute of another subsequent print media;

selectively associating a range of values of at least one of the attributes of the subsequent paper with the subsequent paper tray, using the printer user interface;

determining whether the ranges of values associated with the first paper tray or the subsequent paper tray include the print media attributes required by a print job received by a control system of the printer; and feeding a print mechanism of the printer from the one of the first paper tray or subsequent paper tray having the ranges of values including the print media attributes required by the print job.

11. The method of claim 9 further comprising:

selectively associating a specific value of at least one other of the attributes of the first paper with the first paper tray, using a printer user interface; and feeding a print mechanism of the printer from the first paper tray if the ranges of values and the specific values associated with the first paper tray include the print media attributes required by a print job received by a control system of the printer.

12. The method of claim 9 further comprising:

selectively associating all values of at least one other of the attributes of the first paper with the first paper tray, using a printer user interface; and feeding a print mechanism of the printer from the first paper tray if the values associated with the first paper tray include the print media attributes required by a print job received by a control system of the printer.

13. A method of optimizing print media definition in a printer having a plurality of print trays comprises:

loading a first print media selected from a plurality of print media into a one of the paper trays, the plurality of print media being defined by a set of attributes, each attribute within the set of attributes having a set of values that includes all such values that may be used to identify the associated attribute across all of the print media, the first print media having specific values for the set of attributes;

loading a subsequent print media selected from the plurality of print media into at least one other of the paper trays, the subsequent print media having specific values for the set of attributes;

selectively associating a specific value, a range of values, or all values of at least one of the attributes of the first paper with the one of the paper trays, using a manual printer user interface selected from a keyboard, a pointing device or a touchscreen;

selectively associating a specific value, a range of values or all values of at least one of the attributes of the subsequent paper with the at least one other of the paper trays, using the manual printer user interface, at least one of the values associated with the at least one other of the paper tray being different from the value for a corresponding attribute of the one of the paper trays or a corresponding attribute of another one other of the paper trays; and determining whether the ranges of values associated with the one of the paper trays or the at least one other of the paper trays include the print media attributes required by a print job received by a control system of the printer; and feeding a print mechanism of the printer from the paper tray having values including the print media attributes required by the print job.

14. The method of claim 13 wherein a range of values is associated with at least one of the attributes of the first paper with the one of the paper trays.

15. The method of claim 13 wherein all values of at least one of the attributes of the first paper are associated with the one of the paper trays.

16. The method of claim 13 wherein a range of values is associated with at least one of the attributes of the first paper with the one of the paper trays and a range of values is associated with at least one of the attributes of the subsequent paper with the at least one of the other paper trays.

17. The method of claim 13 wherein feeding a print mechanism comprises feeding from a default paper tray when more than one paper tray of the printer has values including the print media attributes required by the print job.

* * * * *